US005129514A

United States Patent [19]

Lilley, Jr.

[11] Patent Number: 5,129,514

[45] Date of Patent: Jul. 14, 1992

[54] FLEXIBLE CORD WINDING AND PACKAGING CONFIGURATION AND METHOD FOR MAKING SUCH PACKAGE

[75] Inventor: Thomas F. Lilley, Jr., Simsbury, Conn.

[73] Assignee: The Ensign-Bickford Company, Simbury, Conn.

[21] Appl. No.: 743,878

[22] Filed: Aug. 12, 1991

[51] Int. Cl.[5] ..... B65D 85/00; B65B 63/04

[52] U.S. Cl. ..... 206/388; 102/202.12; 206/3; 53/430

[58] Field of Search ..... 206/388, 3; 102/202.12; 53/430

[56] References Cited

U.S. PATENT DOCUMENTS

| | | | |
|---|---|---|---|
| 1,983,141 | 12/1934 | McFarland | 206/388 X |
| 2,393,221 | 1/1946 | Mercer et al. | 102/202.12 |
| 4,089,409 | 5/1978 | Cerwin | 206/388 |
| 5,024,324 | 6/1991 | Whittaker | 206/388 X |
| 5,070,789 | 12/1991 | True et al. | 102/202.12 X |

FOREIGN PATENT DOCUMENTS

| | | | |
|---|---|---|---|
| 139091 | 6/1975 | United Kingdom | 206/388 |

*Primary Examiner*—William I. Price

*Attorney, Agent, or Firm*—Donald J. Hayes; R. William Reinsmith

[57] ABSTRACT

The present invention combines the advantages of a prior art figure of 8 winding pattern with the traditional circular or oval pattern for packaging flexible cord to form what can be called a "figure of 80 pattern" which includes a generally S-shaped partial cord layer with the end of the S joining with a J-shaped portion arranged so that the straight portion of the J forms a continuation of the S and the curved portion of the J overlies the beginning of the S-shaped portion. This basic combination of S and J shapes designates only partial layers, the pattern can be repeated, that basic pattern can be connected to a plurality of oval turn layers or even a plurality of figure 8 turn layers as the user may elect. It is also possible to continue to merely alternate the basic layer form to provide a package having a high packaging density while permitting easy accommodation of fittings which are secured to the end of the cord.

13 Claims, 4 Drawing Sheets

FLEXIBLE CORD WINDING AND PACKAGING CONFIGURATION AND METHOD FOR MAKING SUCH PACKAGE

TECHNICAL FIELD

This invention generally relates to techniques methods and arrangments for winding and packaging flexible cords and the like and is particularly useful for cord and tubing products deployed from their package for single use such as in blasting initiation systems.

BACKGROUND OF THE INVENTION

It has long been known to package electrical wire including pairs of electrical wires having particular utility in the blast initiation field in what is referred to as a "figure of eight" winding, so noted because the product is in fact arranged in a package having overlying turns with the appearance of a figure 8, with reversals of direction of wire orientation on each layer and it is believed that such a winding pattern for packaging has been in use for more than 100 years. It is generally conceded that such figure 8 arrangements provide comparatively tangle-free deployment of the cord or wire contained therein. The typical prior art figure 8 package pattern has crossovers through the center of the coil that serve to keep the coil in layered sequence and reverse the direction of the circular portion of the wind so that any twist induced during preparation of the cord package is reversed during deployment to produce the desired tangle-free dispensing.

Cord products are also made subject to generally circular winding for packaging and are often put in coils or wound onto a spool so as to produce the desired ease of deployment. When using spools or similar special packaging, increased cost becomes a major consideration and disposal of spools increases required labor. So-called "coreless" packaging including unique winding patterns which produce the self-supporting feature of the product coil often produce significant difficulties in dispensing resulting in tangles, kinks, etc.

A further major packaging factor is utilization of a cord winding and packaging arrangement for cord that is provided with attachments, end fittings or devices at each end which form a part of the product to be dispensed from the package. Commonly, blast initiation cords which are used in mining and the construction industries generally have at least one end fitting which must be accommodated in the package. Finally, producing a package which is sufficiently compact and "dense" as to minimize the space that is occupied by the package and its end fittings is a matter of considerable importance when shipping and storing product.

OBJECTS OF THE INVENTION

It is therefore a primary object of this invention to provide a compact package for flexible cord and the like which package permits effective storage and shipment while permitting substantially tangle-free deployment or dispensing.

It is a further object of this invention to provide such a compact package which is easily "constructed" without use of special spools or other winding devices that must be shipped with the product and thereafter stored or destroyed.

It is a still further object of the invention to provide a self-supporting cord package capable of substantially tangle-free deployment which package may assume a variety of shapes ranging from circular to oval to oblong and which accommodates end fittings with minimum additional space consumption.

It is an additional object of this invention to provide a package combining the prior art benefits of a figure 8 winding package with its reversal of direction upon winding while eliminating the buildup of crossover thickness normally attendant to such figure 8 configurations.

It is a still further object of this invention to provide a package particularly suited for use in commercial blast initiation application wherein the packaged cord has fittings at both ends, which cord must be quickly deployed without tangling and without special operator training and which provides a low cost "residue free" package that greatly simplifies site use, transportation, handling and storage, while achieving these advantages with low cost and the absence of special fixtures.

Other objects will be in part obvious and in part pointed out in more detail hereinafter.

A better understanding of the objects, advantages, features, properties and relations of the invention will be obtained from the following detailed description and accompanying drawings which set forth certain illustrative embodiments and are indicative of the various ways in which the principles of the invention are employed.

SUMMARY OF THE INVENTION

In its simplest form, the present invention combines the advantages of a figure of 8 winding pattern with the traditional circular or oval pattern for packaging flexible cord to form what can be properly called a "figure of 80 pattern" which, in its least complicated form includes a generally S-shaped partial cord layer with the end of the S joining with a J-shaped portion arranged so that the straight portion of the J forms a continuation of the S and the curved portion of the J overlies the beginning of the S-shaped portion. The stated combination of S and J shapes designates only partial layers and can be repeated or combined with interspersed oval turn layers or even a plurality of figure 8 turn layers as the user may elect.

DETAILED DESCRIPTION OF THE DRAWINGS

Figure 1A:
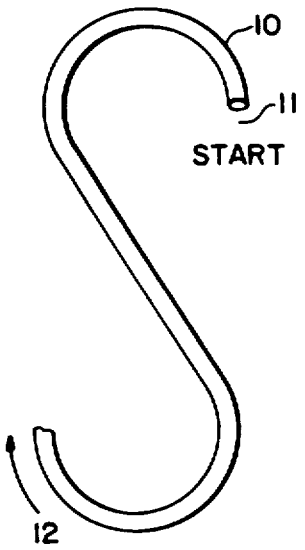
FIGS. 1A, 1B and 1C are schematic illustrations of the formation of the prior art figure 8 winding pattern with adjacent layers in overlying relationship.
Figure 1B:
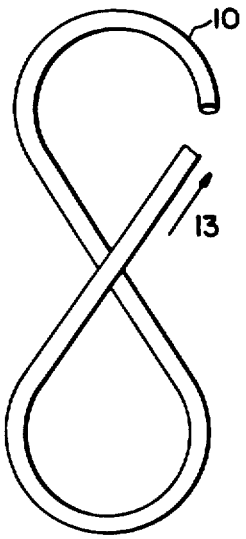
Figure 1C:
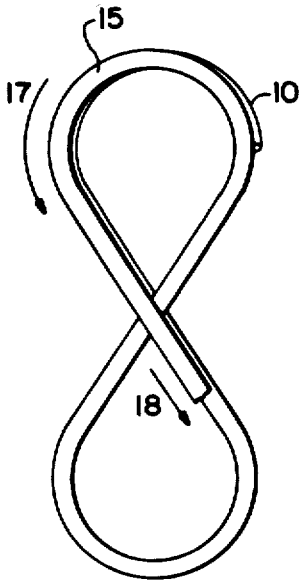

In order to understand the benefits to be achieved with the several variations of the present invention, it is useful to understand the figure of 8 winding pattern of the prior art. Turning first to FIGS. 1A, 1B and 1C, it is seen that flexible cord 10 has a starting end 11 which is formed into an S-shape as best seen in FIG. 1A with the winding pattern proceeding in the direction of arrow 12. While it is seen that FIG. 1A basically describes a S-Shape, it is seen in FIG. 1B that cord 10 as it continues the winding pattern in the direction of arrow 13 begins to describe a figure 8 shape. Turning next to FIG. 1C the winding pattern continues by forming a second turn layer 15 over beginning layer 10 as the pattern moves in the direction of the arrow 17 to form a second cross-over point in the center of the "8" and the winding pattern continues in the direction of arrow 18; that pattern can be repeated as many times as is desired in accordance with the size of the desired package. A benefit of figure 8 winding is that the wind direction is reversed with each cross-over so as to minimize cord twist during deployment of the cord; additionally, the cross-overs with appropriate containment by a frangible band or sleeve, (see FIG. 7, for example) keep each wind in succession during handling and deployment; with the cross-overs in the middle held tightly, components attached to the ends of the cord (see FIGS. 5 and 7) will not slip through the winding layers so as to cause difficulties during deployment. The issue of "reversals" is best seen in FIGS. 1A, 1B and 1C which show the provision of two cross-overs which complete the figure 8 pattern to provide two reversals of direction for the circular wind and the related twist in the cord.

Before proceeding with the description of the preferred embodiment of the invention, it is believed useful to consider the factors which bring about the occurrence of twist in both the winding and in deployment of the cord or tube with which this invention is used. Cord can be wound in a sequence of turns to produce a layered package. Upon deployment of cord from such a layered package, the cord end being extended is not able to rotate about its nuetral axis and the remaining package is not able to rotate about any axis; hence, there is a change in the number of twists in the cord equal to the number of turns of the cord as the cord moves from its packaged state into its deployed state. In general, cord containing twist while in the package will lose that twist as the turns are extended linearly through the deployed cord and cord with no twist in the packaged state will become twisted as the turns are extended.

A packaged turn pattern that features reversal of the direction of the turn (produced with overlapping S-shaped segments) is beneficial. With no twist in the packaged cord during deployment, the deployed section will become twisted until a reversal enters the deployed section which is followed by a reversal in the cord twist; with twist in the packaged cord during the deployment the twist goes to zero as the turns become extended and no twist accumulates in the deployed cord.

To summarize, with periodic, (the more frequent the better) reversals in turn direction in packaged cord achieved with overlapping S-shaped segments, it is possible to minimize or virtually eliminate twist by minimizing twist accumulation in the cord as it is wound in the package or as it is deployed.

Figure 5:
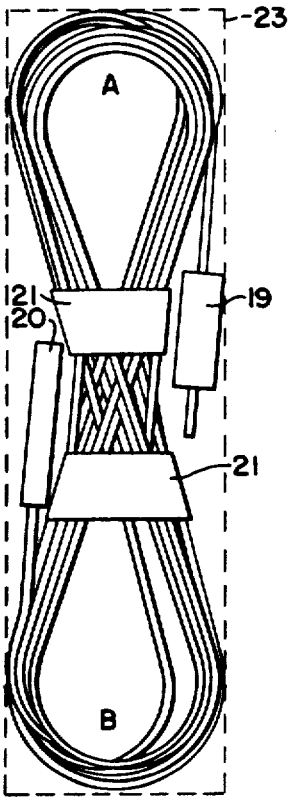
FIG. 5 is a schematic view showing a figure 8 package of the prior art wherein each layer comprises a figure 8 with a center cross-over to keep the pattern in sequence.
Figure 6:
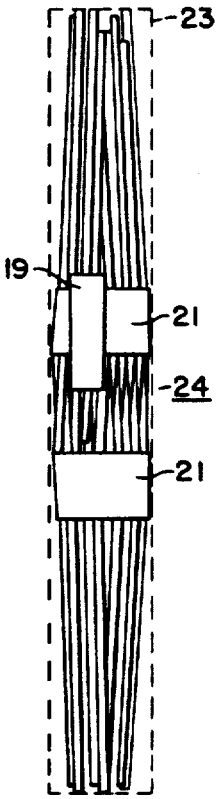
FIG. 6 is a side elevation view of the package of FIG. 5.
Figure 8:
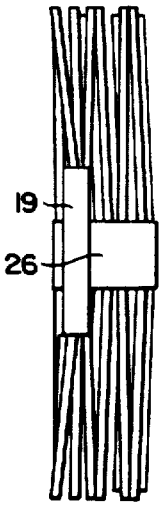
FIG. 8 is a schematic side elevation view of the package of FIG. 7.

Turning next to FIGS. 5 and 6 showing a figure 8 pattern, it is seen that a package having center cross-overs occurring from constant repetition of the overlapping S-shaped configuration will produce a figure 8 pattern which, in the illustrated embodiment of FIG. 5 is held together by two (2) frangible paper binders 21 with the end fittings 19 and 20 stored in the area adjacent to the central overlap portion thereby producing a visible bowtie effect to accommodate the storage at the end fittings. The package identified by the dotted lines 23 serves to illustrate rather long turns when encased in shipping package 23 due to the space available within that container. Clearly there is wasted space to be found at the centers of the turn portions A and B and when, viewing the side view of the package as shown on FIG. 6, the extensive center height or width at 24 is seen even with the bands 21 tightly compressing the material. Nonetheless, considerable "air space" is provided.

Figure 7:
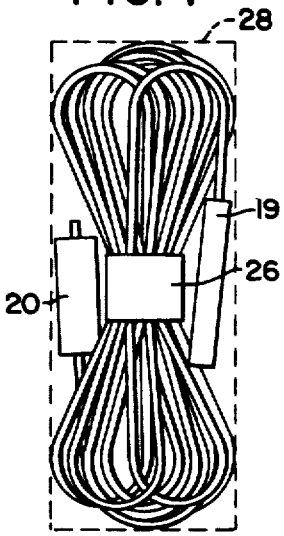
FIG. 7 is a schematic view of a variation of the packaging of FIG. 5.

In an effort to conserve space it is possible to reduce the length of the individual turns and create a somewhat more random pattern as best seen in FIGS. 7 and 8 such a smaller package (within dotted line 28) provides more effective use of space including storage of end fittings 19 and 20 but it is still clear that maximum space utilization is not secured and that the center height at the bank 26 (the cross-over point) requires special packaging.

It is thus seen that the prior art embodiment of FIGS. 5, 6, 7 and 8 produces a figure 8 coil which solves the twist issue and that the cross-overs help to keep the wraps in sequence. However, as best seen in FIGS. 6 and 8, the penalty of the center cross-overs is a thick midsection for the coil and a shape that does not lend itself to easy placement of components in the center areas. Reducing the overall dimensions as seen in FIG. 7 helps to improve density but the smaller the size makes it more difficult to hold a figure 8 wraps in position.

Figure 14:
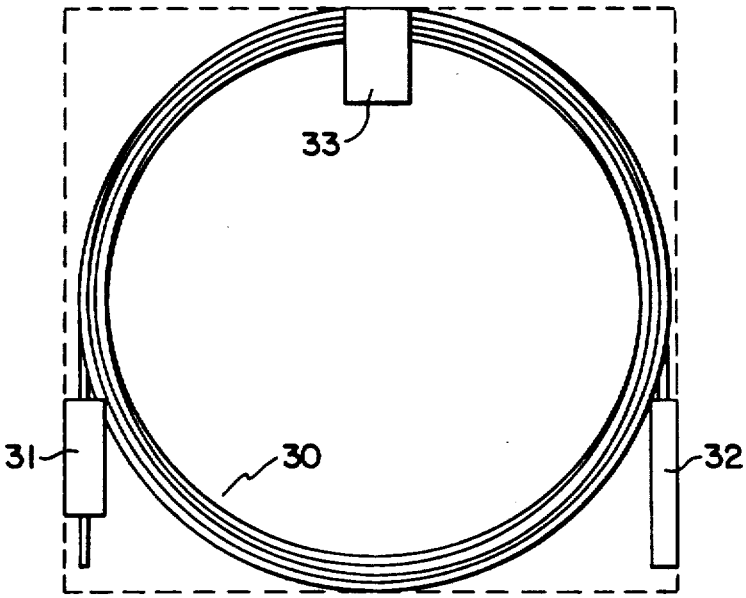
FIG. 14 is a top plan view of a circular package.
Figure 15:
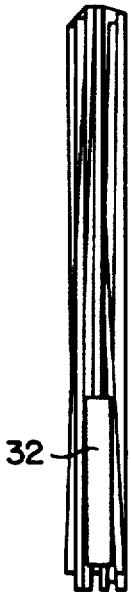
FIG. 15 is a side elevation view of the package of FIG. 14.
Figure 16:
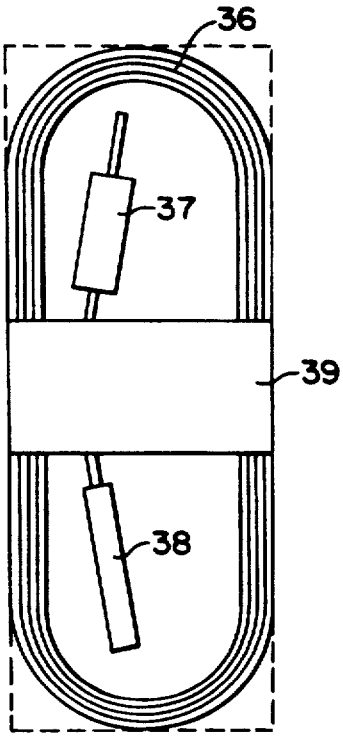
FIG. 16 is a top plan view of an oval package.
Figure 17:
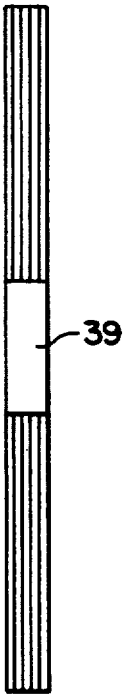
FIG. 17 is a side elevation view of the package of FIG. 16.

Turning next to FIGS. 14 and 15, a circularly wound coil 30 having end fittings 31 and 32 restrained by wrap 33 illustrates what might be called the maximum amount of wasted space. By changing the circular coil to an oval or oblong shape as seen in FIGS. 16 and 17, the amount of wasted space in the center of the coil 36 is reduced but leaving space for end fittings 37 and 38 and held in position by wrap 39; with such coils wound entirely in the same direction the resulting twist buildup and occasion for tangles during deployment remains.

Figure 2A:
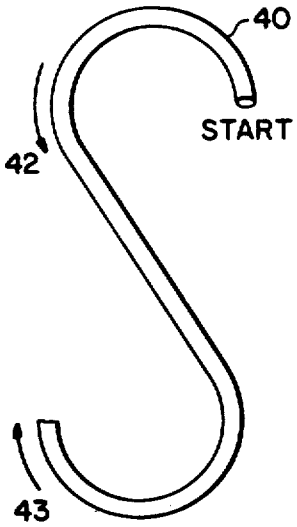
FIG. 2A is a schematic view showing the beginning of the winding configuration of the present invention illustrating the generally S-shaped portion.
Figure 2B:
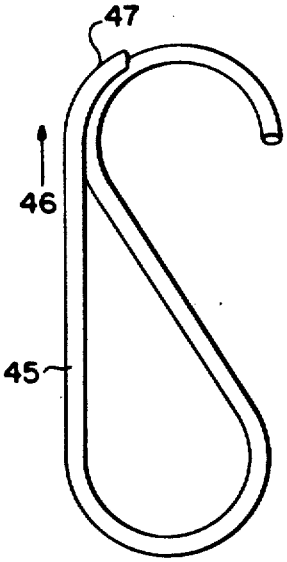
FIG. 2B shows a schematic view of the continuation of the FIG. 2A with a generally J-shaped winding portion.
Figure 2C:
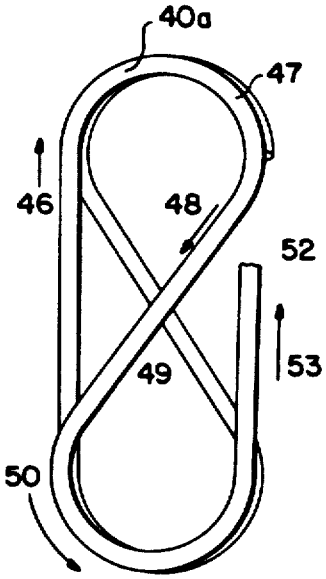
FIG. 2C shows a continuation of the pattern of FIG. 2B with an additional partial S cross-over configuration.

Turning now to the details of this invention, FIGS. 2A, 2B, and 2C that illustrate the creation of the fundamental layer of applicant's figure 80 packaging concept. Starting with the beginning of the S-shaped package at 40 and with the shape proceeding in the direction of the arrow 42, it is seen that a standard S configuration is produced as the wind continues in the direction of arrow 43. However, in contradistinction to FIG. 1B, FIG. 2B shows that winding portion 45 continues straight up in the direction of arrow 46 and curving at 47 to produce what is, in effect, an inverted J-shaped partial turn extending from the S-shaped partial turn. As best seen in FIG. 2C, the J continues through 47 and then forms part of another cross-over moving in the direction of arrow 48 crossing over center X portion 49 and proceeding in the direction of arrow 50 to overlie the generally S-shaped portion beneath it and continuing straight up in winding portion 52 as shown by arrow 53.

In its simplest form, the figure 80 pattern consists of the same or similar S-shape as seen with the figure 8 pattern followed by a circular or oval or oblong pattern generally designated as a "J portion" which is followed by a reversal extending through a cross-over followed by a circular winding in the reverse direction of the previous circular winding to form a basic layer. That basic layer can be repeated indefinitely or interspersed with other layer forms to achieve the size package that is desired.

Figure 3:
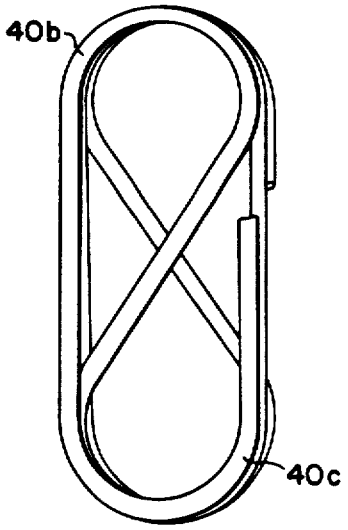
FIG. 3 is a schematic view of a partial cord package of this invention which illustrates a continuation of the pattern shown in FIG. 2C with an additional oval turn.

The circular winding portion of cord 40 between S-shaped cross-overs may be as little as half-wind **40*a* as depicted in FIG. 2C or of any greater length in half-wind increments 40*b* and 40*c* (see partial example in FIG. 3**). The amount of circular winding can be referred to as the ratio of circular winds in half-wind increments to the cross-over half-wind. Obviously the smallest ratio would be 1:1, a half circular wind between each cross-over. A 4:1 ratio consists of four (4) circular half-winds or two (2) full circular winds between each cross-over. By increasing the ratio there are less center cross-overs per total unit length and thus more room for the storage of components in the center section. However, the benefit of the cross-overs for achieving tangle-free deployment is likely to be noticeably diminished if the ratio is too high. Additionally, if end components are not a factor the best product density can be achieved with a ratio of 2:1 or 3:1.

Figure 4:
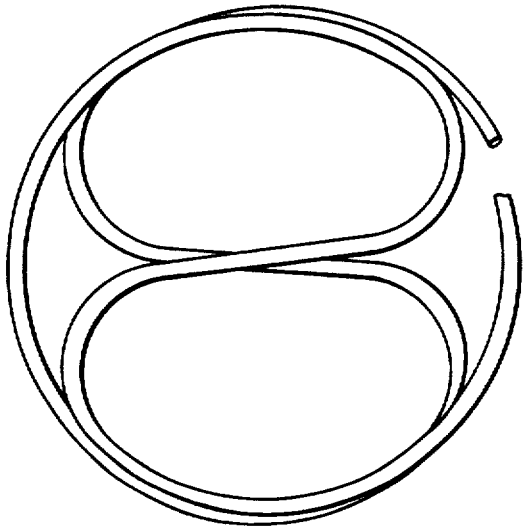
FIG. 4 is a top plan view similar to that of FIG. 2 showing that the general outline configuration of the turns can be varied.
Figure 9:
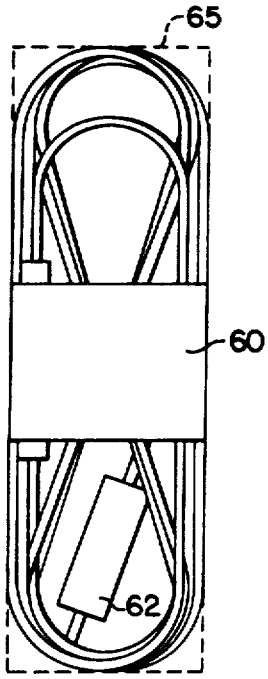
FIG. 9 is a top plan view of a schematic cord arrangement of the present invention.
Figure 10:
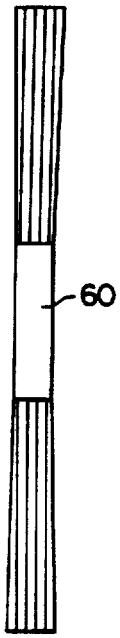
FIG. 10 is a side elevation schematic view of the winding package of the present invention.
Figure 11:
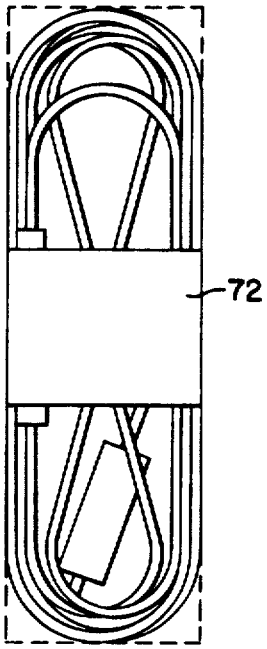
FIG. 11 is a top plan view of a slightly modified form of the invention similar to FIG. 9 wherein nesting of the end turns occurs.
Figure 12:
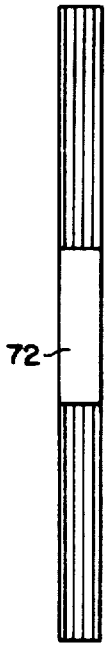
FIG. 12 is a schematic elevational view.

For completeness, it is noted that the benefits of the figure of 80 winding pattern are not dependent upon any particular oblong shape but rather can be achieved with circular or oval configurations with various sizes and proportions as suggested by comparing FIG. 3 and FIG. 4. To better illustrate the improved product wind density, consider the completely circular wound coil of FIG. 14 and its excessive use of space and of course the complete figure 8 winding of FIGS. 5 and 7 with its excessive center space with the figure of 80 pattern shown in FIGS. 9 and 11. A single frangible band 60 (also 72) can be used for a figure of 80 package made in accordance with the present invention and with as many layers as desired to accommodate end fittings 62 and 63 with reduced cross-sectional thickness (see FIGS. 10 and 12) thereby enhancing the effective use of the packaging outline seen at 65, the dotted line outline of a package surrounding that figure of 80 pattern. FIGS. 11 and 12 show a similar configuration to that of FIGS. 9 and 10, albeit with fewer "X" cross-overs but still producing a substantially effective use of all space with a single wrap 72. In effect FIG. 11 differs from FIG. 9 in that there is a more random arrangement of the oval end turns in an effort to create a more effective utilization of space.

Figure 13:
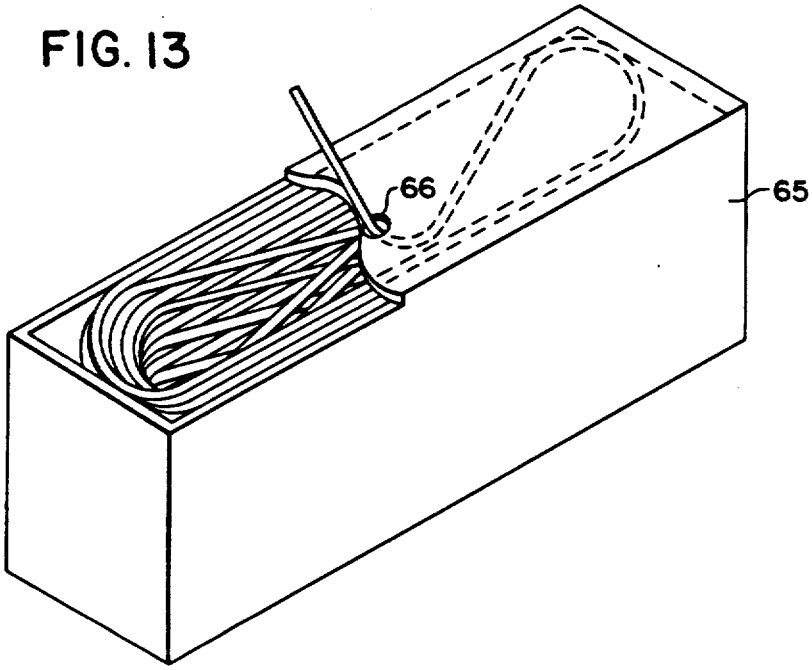
FIG. 13 is a partial perspective view of the cord package of the present invention disposed within a container to facilitate dispensing of the cord.

FIG. 13, a schematic isometric view shows a typical container having the outside configuration of the dotted line 65 with the materials dispensed through a cover aperture 66.

It is therefore seen that the present invention provides a novel packaging layer which can be repeated, interspersed with other winding layers or otherwise varied to provide effective packaging density with substantially tangle-free dispensing.

As will be apparent to persons skilled in the art, various modifications, adaptations and variations of the foregoing specific disclosure can be made without departing from the teachings of this invention.

I claim:

1. In a packaging pattern for a flexible cord to be dispensed in an endwise direction and in a substantially tangle-free manner, a partially overlying cord turn configuration comprising:

a generally S shaped partial cord layer having an arcuate beginning portion, a central portion and an arcuate end portion; and a J-shaped partial cord layer having a straight leg and an arcuate end, the straight leg end of the J-shaped partial cord layer being a continuation of the arcuate end portion of the S-shaped partial cord layer, and the aucute end of the J-shaped layer partial cord overlying the arcuate beginning portion of the S-shaped partial cord layer.

2. The high turn density package for dispensing flexible cord of claim 1 wherein a second J shaped partial cord layer is provided with the straight leg portion of the second J-shaped partial layer being an extension of the arcuate end of the first J-shaped portion and crossing over the central portion of the S-shaped partial layer, the arcuate end portion of the second J-shaped partial layer partially overlying the end portion of the S-shaped layer.

3. The package of claim 2 wherein the arcuate end portion of the second J-shaped partial layer extends to a second S-shaped partial layer whose orientation is reversed relative to the first S-shaped partial layer.

4. The package of claim 3 wherein the free end of the second S-shaped partial layer extends to the curved end portion of a reversed J-shaped partial layer.

5. The package of claim 1 wherein the J-shaped partial cord layer straight leg portion is arcuate thereby to provide a generally circular package configuration.

6. The package of claim 2 wherein the continuous flexible cord comprises a plurality of layers with the partial layer configuration repeated to form the complete package of continuous cord of the desired length.

7. The package of claims 1, 2, 3, 4, 5, or 6 wherein cord end fittings secured to the cord ends are nested within the spaces enclosed by the J-shaped portions of the layered package.

8. A continuous length of cord disposed in a configuration forming a high product density package comprising interleaved and repeated S-shaped cord portions and J-shaped cord portions arranged in partially overlying relation and in end to end continuing connection to provide a continuous length of cord in a package permitting substantially tangle-free dispensing.

9. The package of claim 8 wherein the continuous flexible cord package includes a frangible band surrounding the package to restrain the package during shipping and handling.

10. A portion of a packaging pattern for a continuous cord comprising at least one generally "S" shaped layer having a beginning portion, a central portion and an end portion the end portion continuing as a second layer portion extending to overlie the beginning portion of the S layer without crossing the central portion.

11. The portion of a packaging pattern for a continuous cord as set forth in claim 10 wherein said end portion continues from the overlying position to a crossover generally opposite to the direction of the central portion of the underlying S layer thereby to form an "X" appearance.

12. A method for forming a flexible cord package including a partially overlying cord turn configuration for dispensing the cord in an endwise direction and in a substantially tangle-free manner comprising the steps of forming a generally S shaped partial cord layer having an arcuate beginning portion, a central portion and an arcuate end portion; and forming a J-shaped partial cord layer having a straight leg and an arcuate end, one end of the straight leg of the J-shaped partial cord layer being a continuation of the arcuate end portion of the S-shaped partial cord layer, and the arcute end of the J-shaped layer partial cord overlying the arcuate beginning portion of the S-shaped partial cord layer.

13. The method of claim 12 with the additional step of forming a second J-shaped partial layer as a continuation of the first J-shaped partial layer with the straight J portion crossing over the S-shaped layer portion.

* * * * *

UNITED STATES PATENT AND TRADEMARK OFFICE

CERTIFICATE OF CORRECTION

PATENT NO. : 5,129,514

DATED : July 14, 1992

INVENTOR(S) : Thomas F. Lilley, Jr.

It is certified that error appears in the above-identified patent and that said Letters Patent is hereby corrected as shown below:

Column 4, line 48, wherein the word "bank" should be --band--.

Signed and Sealed this

Sixteenth Day of November, 1993

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,129,514

DATED : July 14, 1992

INVENTOR(S) : Thomas F. Lilley, Jr.

It is certified that error appears in the above—identified patent and that said Letters Patent is hereby corrected as shown below:

Column 8, line 12, wherein "arcute" should be --arcuate--.

Signed and Sealed this

Twenty-first Day of December, 1993

*Attest:*

Bruce Lehman

BRUCE LEHMAN

*Attesting Officer*

*Commissioner of Patents and Trademarks*